United States Patent [19]

Long

[11] 4,074,821

[45] Feb. 21, 1978

[54] OVERCENTER BACKHOE

[75] Inventor: Elton B. Long, Burlington, Iowa

[73] Assignee: J. I. Case Company, Racine, Wis.

[21] Appl. No.: 730,598

[22] Filed: Oct. 7, 1976

Related U.S. Application Data

[63] Continuation-in-part of Ser. No. 576,625, May 12, 1975, abandoned.

[51] Int. Cl.[2] ..... E02F 3/32

[52] U.S. Cl. ..... 214/138 R; 212/144

[58] Field of Search ..... 214/138 R, 138 C, 138 D, 214/138 E, 138 F, 138 G, 145 R; 212/144

[56] References Cited

U.S. PATENT DOCUMENTS 3,376,984 4/1968 Long et al. ..... 214/138 R

FOREIGN PATENT DOCUMENTS 1,484,741 3/1969 Germany ..... 214/138 R 785,585 10/1957 United Kingdom ..... 214/138 R 313,883 12/1929 United Kingdom ..... 212/144

OTHER PUBLICATIONS

Ware Machine Works Inc., advertisement of Sept. 18, 1957.

*Primary Examiner*—Trygve M. Blix
*Assistant Examiner*—Ross Weaver
*Attorney, Agent, or Firm*—Dressler, Goldsmith, Clement, Gordon & Shore, Ltd.

[57] ABSTRACT

A backhoe arrangement is disclosed wherein the boom comprises a pair of transversely spaced apart boom sections so that a single boom cylinder can be mounted therebetween and wherein overcenter forward movement of the boom sections and boom cylinder provide a transport configuration for the backhoe in which the center of gravity is substantially closer to the rear of the vehicle.

6 Claims, 8 Drawing Figures

OVERCENTER BACKHOE

REFERENCE TO RELATED APPLICATION

This application is a continuation-in-part of application Ser. No. 576,625, filed May 12, 1975, now abandoned.

BACKGROUND OF THE INVENTION

This invention relates to power-driven shovels and, more particularly, is concerned with a conventional loader type of backhoe mechanism mounted on a tractor or similar vehicle to present a center of gravity more closely adjacent the tractor, thereby improving the balance and handling during loading and transport.

In the conventional prior art arrangements, the transport position is characterized by a generally vertically and slightly rearwardly extending boom carrying a folded dipper assembly positioned as close as possible to the boom to hold the main center of gravity for the backhoe as near as possible to the rear of the mounting vehicle. However, the main center of gravity is still so far to the rear of the vehicle that mechanical balance relationships are insufficiently stable and handling is unduly difficult, even during normal use as a loader. On conventional backhoes, proper weight distribution is accomplished by placing counterweights on the front of the tractor. Counterweights have the disadvantage of increasing total weight of the vehicle, and do not improve stability due to the inertial moments caused by the length of conventional backhoes.

Commonly assigned U.S. Pat. No. 3,376,984 to Long et al. solves these problems by providing a backhoe arrangement which is arranged to accommodate an overcenter movement of the boom cylinder assembly when the boom is swung to the transport position. In the transport position, the backhoe has a generally vertically and slightly forwardly extending boom held locked in position by the boom cylinder assembly which has gone overcenter. The ability of the boom to assume a more forwardly inclined relationship effects an improvement in the position of the center of gravity to provide better balance and handling and to limit the backhoe tail swing required in close quarter operations.

However, the Long arrangement, and the other prior art arrangements, comprise a single unitary boom flanked on both sides by boom cylinder assemblies, and have the disadvantage of poor visibility of the bucket by the operator.

SUMMARY OF THE INVENTION

In accordance with the present invention, a backhoe arrangement is proved wherein the boom comprises a pair of spaced apart hollow boom sections and a single boom cylinder and piston rod assembly is positioned therebetween. The backhoe arrangement accommodates an overcenter movement of the boom cylinder when the boom sections are swung to the transport position in which the backhoe has generally vertically and slightly forwardly extending boom sections held locked in position by the single boom cylinder assembly which is gone overcenter. When the boom sections are in the transport position and the boom cylinder is overcenter, the backhoe is tucked in closer to the front of the vehicle, the overall length of the vehicle in transport is shortened, and the distance required to turn the vehicle is reduced as compared to vehicles including a conventional backhoe.

By providing a pair of boom sections with a single boom cylinder assembly positioned therebetween, the overall width of the boom sections and the single cylinder is less than where a single boom is provided with boom cylinder assemblies on each side. Visibility is thereby improved, because it is possible to look through the opening provided between the two boom sections. This is especially important when using single point tools and extremely narrow backhoe buckets.

Another feature of the present invention is increased clearance under the backhoe bucket during transport. Unlike conventional backhoes wherein a single boom is flanked by a pair of boom cylinder assemblies, the present invention has a pair of boom sections flanking a single boom cylinder assembly, with clearance between the boom sections and boom cylinders to enable the boom to assume a substantially vertical neutral position. The boom cylinder assembly controls the boom to swing to either side of the neutral position.

According to the present invention, only a single boom cylinder assembly needs to be included in a backhoe arrangement. Furthermore, by positioning the boom cylinder assembly between the two spaced apart boom sections, the boom sections protect the boom cylinder assembly from damage and protect the hoses that supply oil to the bucket cylinder. Preferably, the hoses are located in the hollow boom sections.

More specifically, the present invention includes a vertically extending elongated support attachment having a mounting portion thereon for defining upper and lower horizontal pivot axes. The elongated boom comprises two transversely spaced apart boom sections, ach swingably mounted at one end on the lower pivot axis. The two boom sections are rigidly interconnected at their upper and lower ends to prevent any relative twisting of the boom sections during operation of the bucket.

According to one aspect of the invention, the two boom sections are hollow, rectangular members that are interconnected at the lower end by a rigid sleeve and at their upper end by bracket support means.

The boom sections are also positioned for movement through a neutral intermediate position wherein the boom sections extend substantially vertically and the upper pivot axis is located in a space between the boom sections. A double-acting boom cylinder assembly is pivotally mounted on one end to the upper pivot axis and on the opposite end is pivoted to the boom to extend in the space between the boom sections. The boom cylinder assembly is extendable and retractable to effect swinging movement of the boom and the boom cylinder mechanism to either side of the neutral intermediate position. A material handling unit is pivotally mounted on the bracket interconnecting means which interconnects the opposite ends of the boom sections.

In one version, the bracket interconnecting means includes a bracket that has projections extending into the hollow open ends of the boom sections and the material handling unit pivoted on the outer end of the bracket. In another version, the bracket interconnecting means includes a shaft extending between the boom sections with the material handling unit pivoted on the shaft between the boom sections.

A fluid ram means is employed to effect swinging movement of the material handling unit. A bracket means is mounted on an intermediate portion of each boom section, and the fluid ram means is pivotally mounted at one end to the bracket means and at the opposite end to the material handling unit. In one embodiment, the fluid ram means includes a single cylinder and piston rod assembly. In another embodiment, the fluid means includes a pair of cylinder and piston rod assemblies.

DETAILED DESCRIPTION OF THE PREFERRED EMBODIMENTS

Figure 1:
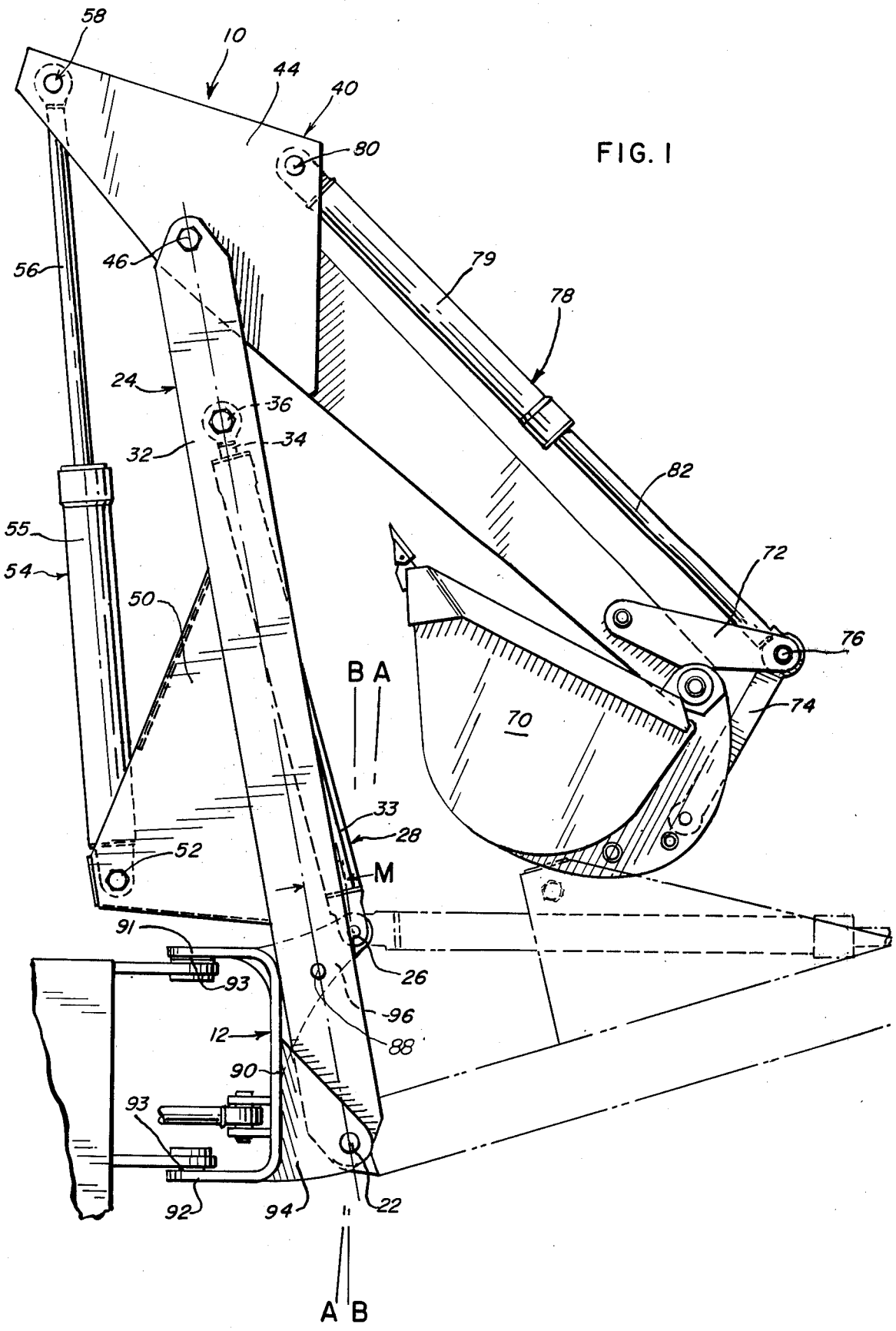
FIG. 1 is a side elevational view of the backhoe of this invention representing in solid lines the parts in maximum transport position wherein the boom cylinder is overcenter relative to the boom to effect a knee lock action, and in phantom represents the parts in a rearward position which is assumed when digging.

Referring now to the drawings, a backhoe arrangement or assembly 10 is shown which is suitable for being pivotally mounted upon the rear of a tractor, as disclosed in U.S. Pat. No. 3,376,984 to Long et al., which is hereby incorporated by reference insofar as it is not inconsistent with the present disclosure.

Backhoe assembly 10 (FIG. 2) includes a support attachment in the form of a swing tower 12 having upper and lower cylindrical openings 14 and 16 which receive swivel pins (not shown in FIG. 2) to pivotally mount the swing tower to a mounting bracket which projects rearwardly from a tractor. The swing tower 12 is positioned by swing cylinder assemblies 18 and 20.

Swing tower 12 has a mounting portion having bottom horizontal pivot shaft 22 mounting a boom 24 and an upper horizontal pivot shaft 26 mounting a boom cylinder assembly 28. According to the present invention, boom 24 comprises a pair of spaced apart hollow rectangular sections 30 and 32 which are swingably mounted at one end thereof on the bottom horizontal shaft 22 by a sleeve 23 which extends between boom sections 30 and is secured thereto. Boom cylinder assembly 28 is of a double-acting type and has a cylinder 33 and a piston rod 34 which is pivotally connected upon shaft 36 located adjacent to but spaced from the free end of the boom sections, and is located within the space defined between boom sections 30 and 32.

Figure 2:
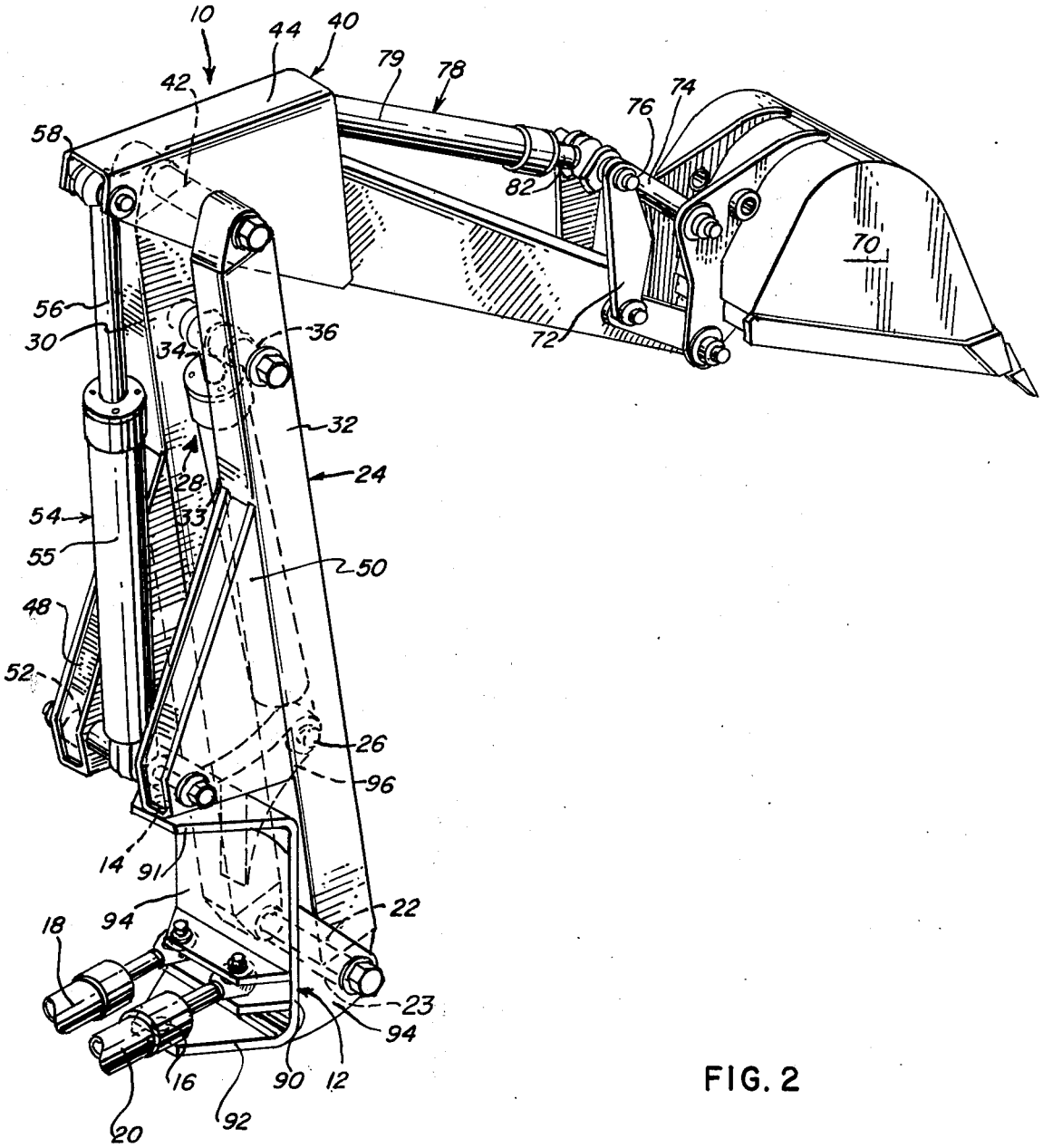
FIG. 2 is a perspective view of the backhoe of FIG. 1 wherein the backhoe has a single cylinder and piston rod assembly.

A dipper stick assembly 40 is mounted on a pivot shaft 42 extending between the free ends of the boom sections 30 and 32 to define a pivot axis for the dipper at a location intermediate its length, but substantially closer to the boom end than to the bucket end of the dipper. The dipper stick assembly 40 includes a rigid attachment plate 44 which receives pivot shaft 42 and constitutes the boom end of the dipper stick assembly. A fluid ram means is employed to effect swinging movement of the dipper stick assembly. Referring to FIGS. 1 and 2, brackets 48 and 50 are mounted on intermediate portions of boom sections 30 and 32, respectively, or may be integral therewith. The brackets are U-shaped in cross-section and have a space between the vertical walls. The brackets have a pivot shaft 52 extending therebetween.

In the preferred embodiment illustrated in FIGS. 1 and 2, the fluid ram means comprises a single dipper cylinder assembly 54, also of the double-acting type. Dipper cylinder assembly 54 has a cylinder 55 and a piston rod 56 which is pivotally connected on a pivot shaft 58 carried at the end corner of the attachment plate 44 and which is axially spaced from pivot shaft 42. Dipper cylinder 55 is pivotally mounted on pivot shaft 52 between brackets 48 and 50.

A bucket 70 is pivotally attached to the free end of the dipper in the conventional way. A pair of drive links 72, 74 are pivoted to the dipper 40 and bucket 70 and are interconnected by a floating knee shaft 76. A bucket cylinder assembly 78 of the double-acting type has a cylinder 79 mounted on a pivot shaft 80 carried on an upstanding corner of the dipper attachment plate 44 and has a single-ended piston rod 82 pivotally connected to the knee shaft 76.

The present backhoe arrangement has a normal transport position as shown in solid lines in FIG. 1, wherein the boom extends generally vertically and slightly forwardly, and the center of gravity of the backhoe part is closer to the front end of the tractor. The boom cylinder assembly 28 has a moment arm M, so that any application of hydraulic pressure to the head end of the boom cylinder tends to force boom 24 forward against swing tower 12 resulting in knee lock joint to hold the parts in the FIG. 1 position. If desired, boom 24 may be mechanically locked to swing tower 12 by a bolt (not shown) extending holes 88 in boom sections 30 and 32 and swing tower 12. Balance and handling of the unit is greatly improved as the effective center of gravity has been shifted forward by more than 50% as compared to conventional prior art structures.

The swing tower 12 includes a vertical wall 90 having horizontal upper and lower forwardly projecting walls 91 and 92 having openings 14 and 16 which receive mounting brackets 93 on the tractor. Swing tower 12 further includes a pair of rearwardly projecting sidewalls 94 defining a channel space therebetween in which boom sections 30 and 32 are nestable. Sleeve or elongated spacer bearing 23 is secured to boom sections 30 and 32 and receives horizontal pivot shaft 22 to maintain the boom sections in spaced apart relation and rigidly interconnect the boom sections at the lower end. Swing tower 12 also has a vertical wall 96 projecting rearwardly from a centrally located position on an upper portion of swing tower 12. Vertical wall 96 has the upper horizontal pivot shaft 26 to which boom cylinder 33 is mounted. There is clearance between boom sections 30 and 32 and boom cylinder assembly 28. This arrangement enables the boom to swing fully in a nested position forwardly of vertical line A—A in FIG. 1, this being the transport position, with boom cylinder assembly 28 partially positioned between boom sections 30 and 32.

In the operation of the backhoe, normal loading is performed in the usual way. However, the boom 24 may operate more nearly towards a true vertical position to maintain the center of the backhoe closer to the swing tower 12 and improve the balance and handling characteristics. When the backhoe is swung from the phantom position of FIG. 1 to the solid line position of FIG. 1, hydraulic pressure is applied to the rod end of the boom cylinder assembly 28 to swing the boom to a true vertical position and then slightly forwardly of vertical, wherein the line of action of boom cylinder assembly 28 registers with the center line of the boom sections 30 and 32. The forward momentum of the parts enables the backhoe to continue through this position, wherein the center lines are in registry, toward the solid lines position of FIG. 1. Hydraulic pressure is applied at the piston end of the boom cylinder assembly 28 to assist forward travel of the boom between the position wherein the center lines are in registry to the transport position illustrated in solid lines in FIG. 1. Thereafter, the hydraulic pressure effects a knee lock on the boom to hold the backhoe in the transport position.

It may be noted that the swing tower 12 mounts the boom cylinder pivot shaft 26 slightly rearward of the boom pivot shaft 22 so that in the neutral position indicated by line B—B in FIG. 1, wherein the center line of the boom sections 30 and 32 are in registry with the line of action of the boom cylinder assembly 28, the boom leans slightly forwardly of the true vertical position defined by line A—A. This provides more positive control of assisting the forward momentum in insuring that the backhoe swings overcenter to enable hydraulic pressure to actuate the boom cylinder assembly in a direction to assist the final forward increment of travel.

To shift the backhoe from the solid line position of FIG. 1 towards the phantom position of FIG. 1, hydraulic pressure is applied at the rod end of boom cylinder assembly 28 to initiate rearward swinging movement of the boom. The bucket cylinder 78 is operated at the same time to curl the bucket 70 rearwardly, thereby abruptly shifting the center of gravity to the rear and assisting in the rearward launch of the boom. When the parts move through the position indicated by line B—B in FIG. 1, wherein the center line of the boom sections 30 and 32 is in registry with the line of action with the boom cylinder assembly 28, the hydraulic pressure is released from the rod end of the boom cylinder.

In the following portion of the description, two-digit numerals are used to refer to the embodiments in FIGS. 1 and 2, three-digit numerals 100–199 are used to refer to the embodiment illustrated in FIG. 3, and three-digit numerals 200–299 are used to refer to the embodiments illustrated in FIG. 4. The same last two digits in each numeral designate similar elements in the various embodiments.

Figure 3:
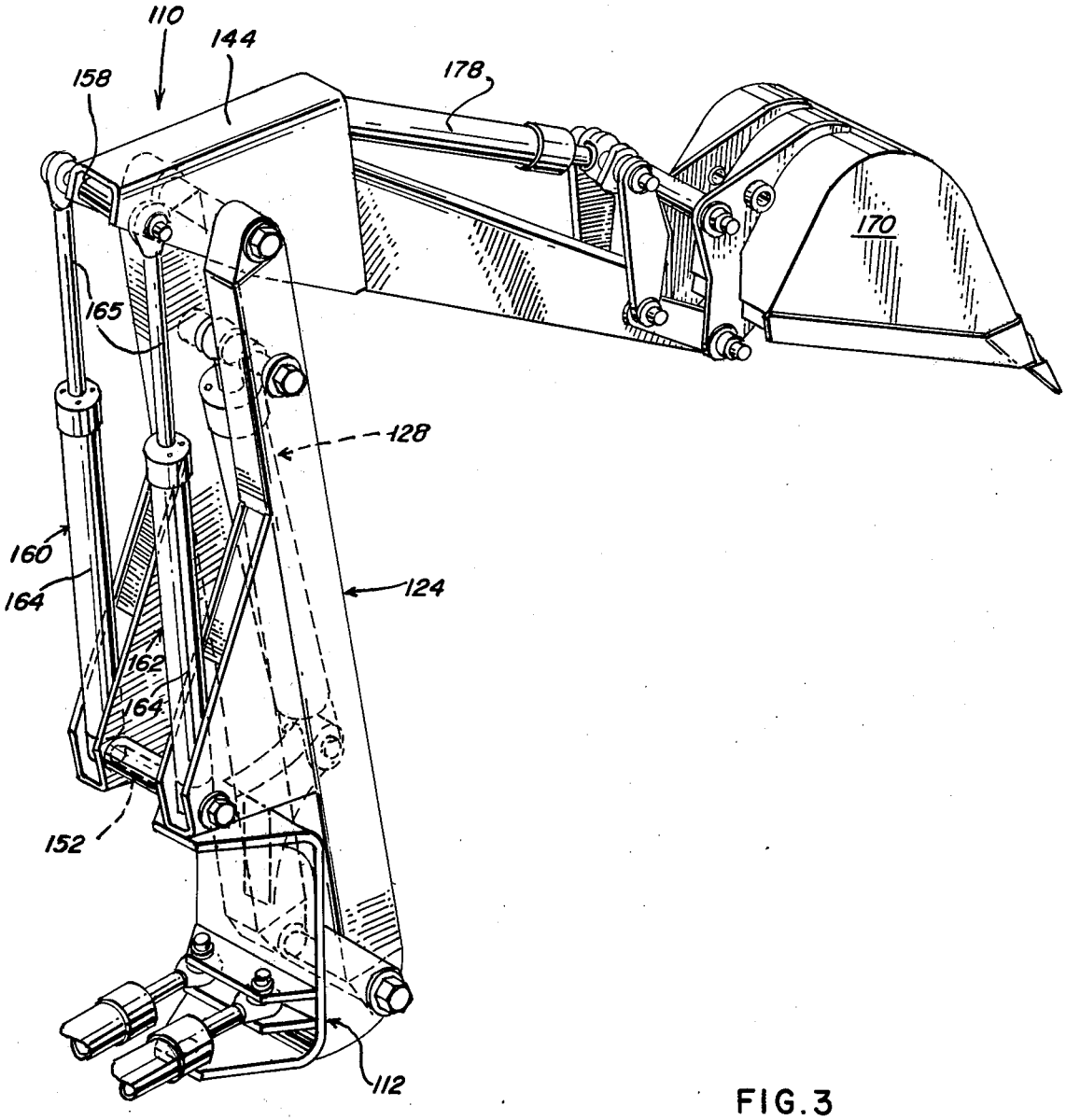
FIG. 3 is a perspective view of an alternate embodiment of this invention wherein the backhoe includes a pair of cylinder and piston rod assemblies.
Figure 4:
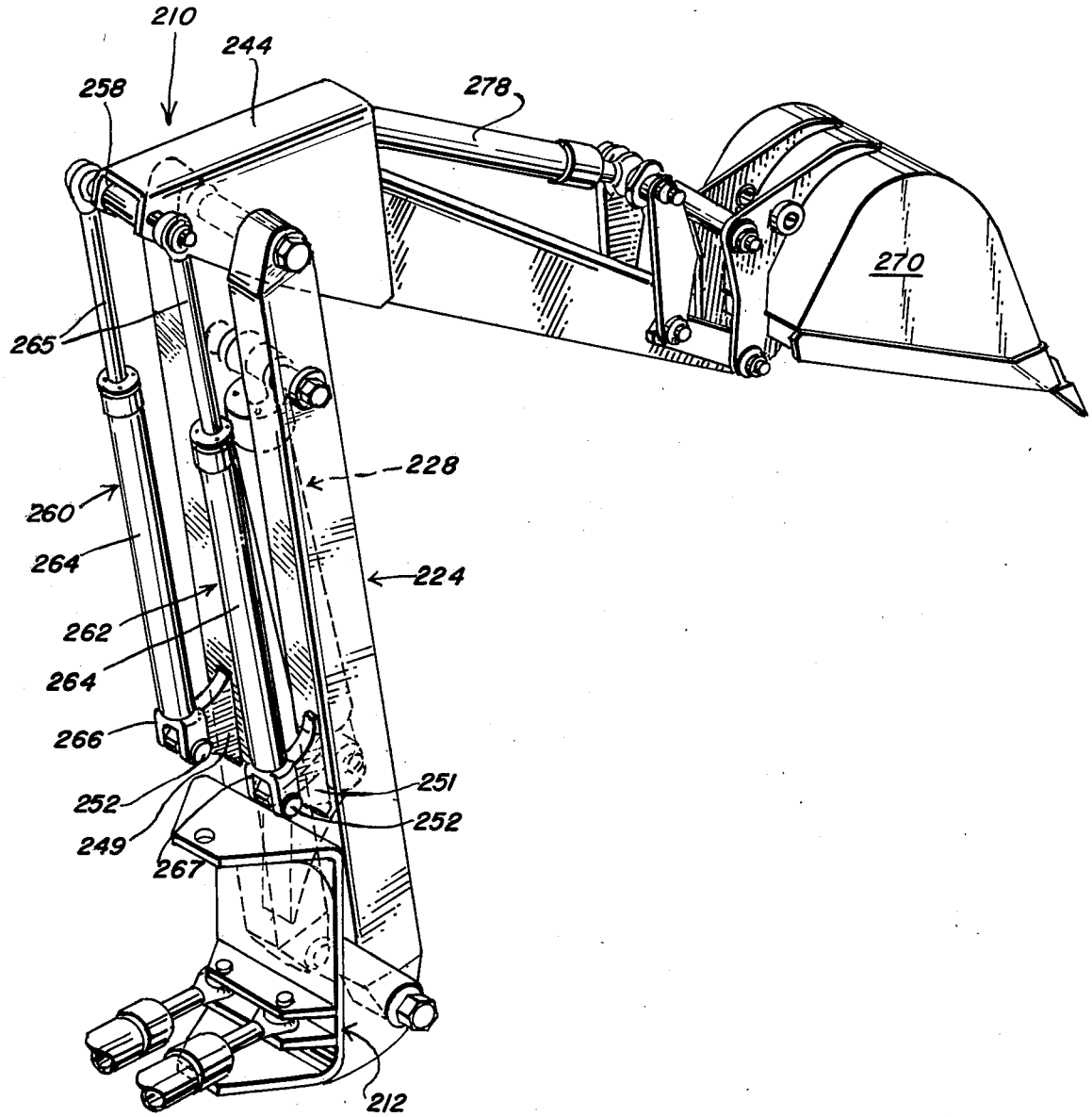
FIG. 4 is a perspective view similar to FIG. 3 and illustrating another alternate embodiment of this invention.

In the embodiments illustrated in FIGS. 3 and 4, the fluid ram comprises a pair of dipper cylinder assemblies 160, 162. Referring specifically to FIG. 3, dipper cylinder assemblies 160, 162 are of the double-acting type and each has cylinders 164 having one end pivotally mounted on pivot shaft 152 with each dipper cylinder located between the parallel lateral walls of an associated bracket. Dipper cylinder assemblies 160, 162 each has a single-ended piston rod 165 pivotally connected on pivot shaft 158 on attachment plate 144. Backhoe 110 is otherwise identical to backhoe 10 of FIGS. 1 and 2.

In the embodiment illustrated in FIG. 4, brackets 249 and 251 are solid, and the dipper cylinders 264 each has a mounting member 266, 267 mounted on one end thereof to separately pivotally mount the dipper cylinder on the brackets. Piston rods 265 are pivotally connected to pivot shaft 258. Backhoe 210 is otherwise identical to backhoe 10 illustrated in FIGS. 1 and 2.

Figure 5:
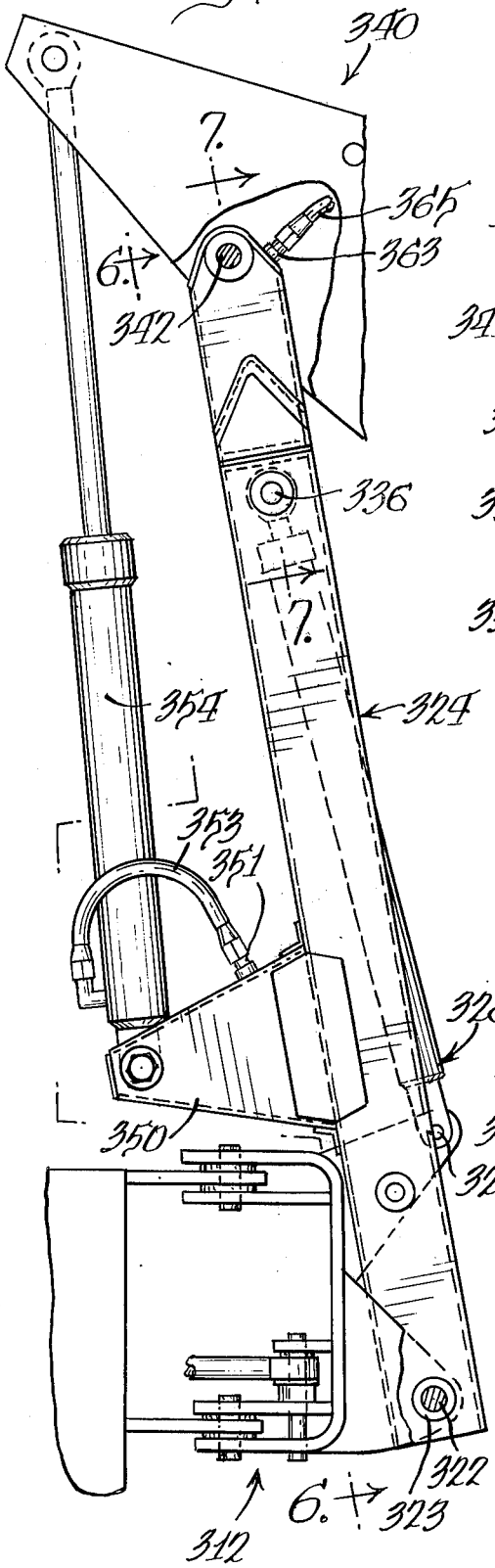
FIG. 5 is a side elevational view similar to FIG. 1 showing one specific construction for the boom.
Figure 6:
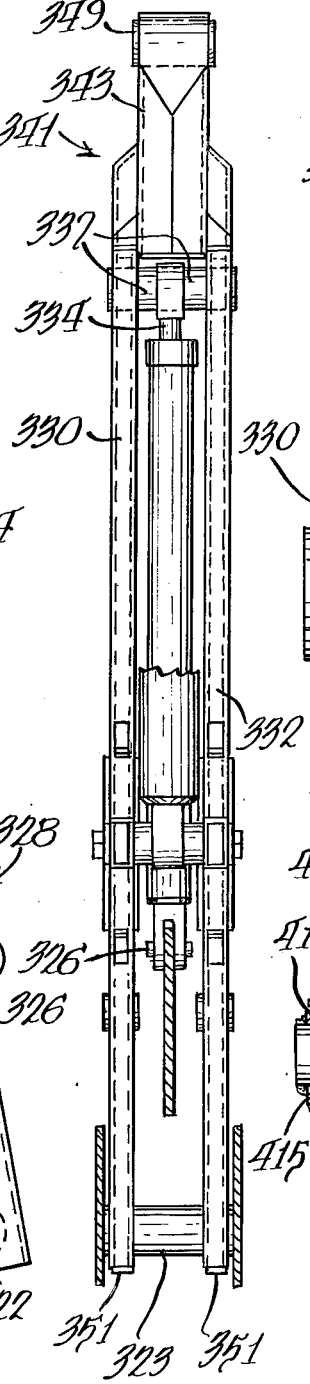
FIG. 6 is an end view of the boom shown in FIG. 5, as viewed along line 6—6 of FIG. 5.
Figure 7:
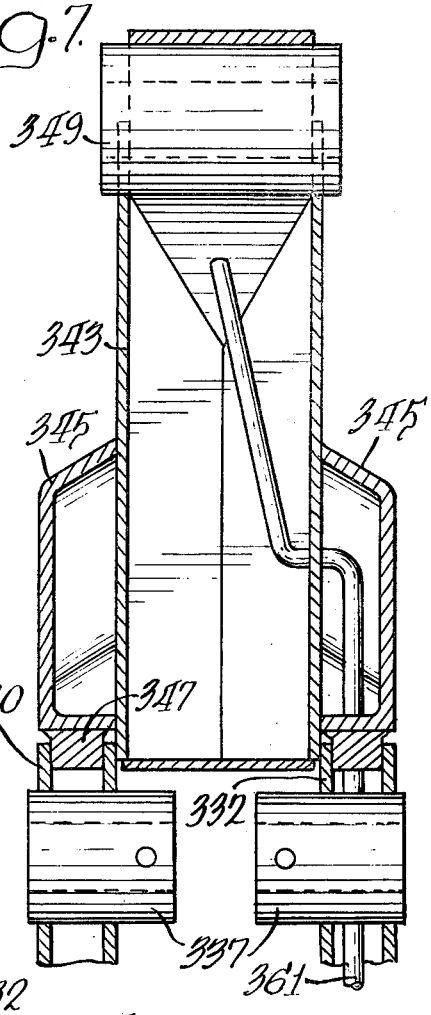
FIG. 7 is an enlarged sectional view of the upper end of the boom shown in FIG. 6.

A further modified form of the invention is shown in FIGS. 5, 6, and 7. Since many of the elements shown in the embodiment of FIGS. 5, 6, and 7 are identical, or very similar to the elements described in connection with the embodiment of FIGS. 1 and 2, three-digit reference numerals 300–399 will be used in describing this embodiment.

As is true of the embodiment shown in FIGS. 1 and 2, boom 324 consists of a pair of transversely spaced hollow rectangulr boom sections 330 and 332 which are interconnected at their lower end by a sleeve 323 that is pivotally supported on shaft 322. As shown in FIGS. 5 and 6, sleeve 323 extends through both hollow boom sections 330 and 322 and is rigidly secured thereto, as by welding. The hollow boom sections 330 and 332 are pivoted about pivot pin or shaft 322 through fluid ram 328 that is pivoted on shaft 326 at one end and pivoted on shaft 336 extending between the two hollow boom sections at the opposite end. Shaft 336 extends through hollow sleeves 337 that are respectively fixedly secured to boom sections 330 and 332, as by welding. Pivot shaft 336 is preferably also welded to either sleeves 337 and/or to hollow boom sections 330 and 332. Thus, sleeves 337 and shaft 336 define a rigid interconnecting means between boom sections 330 and 332. With this arrangement, the sleeves 337 act as spacers for maintaining piston rod 334 centered between the two boom sections.

In the embodiment illustrated in FIGS. 5, 6, and 7, the interconnection means between boom sections 330 and 332 also incorporate bracket support means 341 consisting of a generally hollow rectangular member 343 that has brackets 345 secured to opposed walls thereof. The transverse dimension of hollow member 343 is substantially identical to the spacing between boom sections 330 and 332 and brackets 345, which are preferably welded to member 343, have projections 347 extending from the lower ends thereof. Projections 347 are received into the open ends of hollow rectangular boom sections 330 and 332 to provide a further interconnecting means between the two boom sections so that the boom sections essentially define a rigid integral unit that is capable of withstanding substantial torsional stresses during normal operation of the dipper stick assembly. Hollow member 343 also has a sleeve 349 on the outer free end thereof which receives pivot shaft 342 to pivotally support dipper stick assembly 340 on the outer end of boom 324.

Thus, the embodiment of FIGS. 5, 6, and 7, as the previous embodiments, includes three rigid interconnecting means 323, 336, and 341 between the two boom sections.

The lower ends of boom sections 330 and 332 are preferably closed by plates 351 that may be welded thereto so that the hollow boom sections are completely enclosed and are capable of being used as a reservoir for hydraulic fluid if desired.

However, in the embodiment illustrated in FIGS. 5, 6, and 7, the conduits which supply hydraulic fluid to fluid ram 354 and the bucket cylinder assembly (not shown) are located within hollow boom sections 330 and 332. As more clearly shown in FIGS. 5 and 7, particularly FIG. 7, a rigid or flexible conduit or hose 361 extends through hollow boom section 332 and hollow bracket 345 as well as hollow member 343 and terminates in a connector 363 (FIG. 5) at the upper end of bracket support means 341. Thus, a flexible hose 365 may be connected to connector 363 and to the cylinder asembly (not shown). Of course, it will be appreciated that two such conduits for one cylinder assembly will be located within either of the boom sections 330 or 332.

Likewise, a conduit (not shown) could extend through a portion of hollow boom sections 330 or 332 and through a portion of hollow enclosed bracket 350 and terminate in a connector 351 with a hose 353 extending from connector 351 to fluid ram 354. Again, two such conduits would be used to supply fluid to opposite ends of ram 354.

All of the conduits or hoses could either be flexible members, or could alternatively be rigid members that terminate in connectors 351 and 363.

Figure 8:
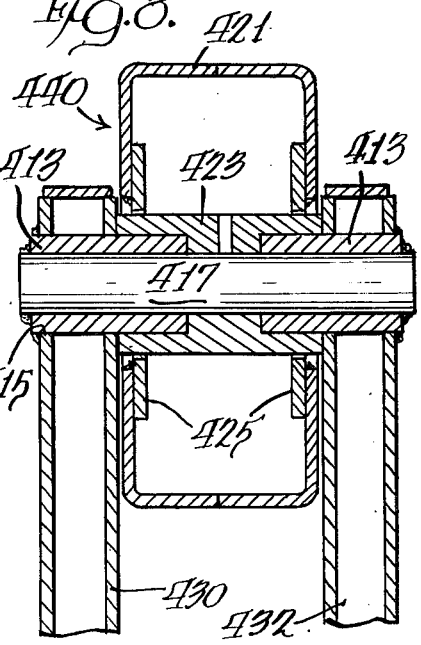
FIG. 8 is a view similar to FIG. 7 showing a slightly modified construction of the bracket support means.

A slightly further modified form of the invention is disclosed in FIG. 8 which is in all respects similar to the embodiment of FIGS. 5, 6, and 7 and the only difference is the interconnecting means at the upper end of the boom. In the embodiment illustrated in FIG. 8, hollow rectangular boom sections 430 and 432 each have a sleeve 413 extending through an opening 415 and welded to the respective boom sections 430 and 432. A shaft 417 extends through the respective sleeves, which are spaced from each other at the inner end and pivotally support a dipper stick assembly 440. In this embodiment, the upper interconnecting means includes sleeves 413 and shaft 417, which define first shaft means and sleeves 336 and shaft 337, which define second shaft means.

Dipper stick assembly 440 consists of a generally rectangular hollow member 421 which has a bearing member 423 extending therethrough and secured thereto as by welding. Bearing member 423 defines the pivotal connection of dipper stick assembly 440 on shaft 417, as well as sleeves 413. In order to rigidify the entire unit, it is peferable that the area surrounding bearing member 423 be reinforced by additional plates 425. Bearing member 423 has an opening 427 for supplying lubricant to relatively movable surfaces.

As can be appreciated, in the embodiment illustrated in FIG. 8, the first shaft means including sleeves 413 and shaft 417 and the second shaft means including sleeves 336 and shaft 337 define the rigid interconnection between the two spaced boom sections 430 and 432 at one end thereof and this interconnection means also includes a sleeve 323 at the lower end of the boom sections.

Summarizing the present invention, in all embodiments of the invention disclosed herein, the transverse spaced boom sections give the operator greater visiblity for observing the operation of the bucket at the outer end of the dipper stick assembly because the operator can view the bucket directly from the operator's station through the space between the boom sections and the single boom cylinder assembly. This is particularly true when the boom is in a lowered position since the only obstruction in that position between the boom sections will be the piston rod of the bucket cylinder assembly, which is normally less than one-half the spacing between the boom sections. This will greatly increase the visibility the operator has for the material handling unit on the outer end of the entire assembly.

Also, the use of two hollow rectangular boom sections and a single boom cylinder assembly greatly reduces the overall cost as well as the overall weight of the backhoe unit. The overall weight reduction not only is obtained from the use of only a single cylinder while still retaining the overcenter feature discussed above, but it also reduces the amount of hydraulic fluid that is necessary to be in the reservoir since one of the fluid rams is eliminated. Also, as explained above, the boom cylinder assembly, particularly the piston rod thereof, is at all times protected by the two boom sections on opposite sides thereof to eliminate exposure of the piston rod to damage.

In addition to the above advantages, the construction illustrated, particularly in the embodiment of FIG. 5, allows for the use of the present commercially available dipper stick asembly that has been manufactured for several years by the assignee of the present invention. Of course, the reduced overall weight of the backhoe unit improves the balance of the entire vehicle during transportation.

The use of twin boom sections and a simple boom cylinder assembly has proven that the overall width of the boom assembly can be decreased by more than 35% of a boom assembly, such as shown in the Long patent, without sacrificing overall strength. In fact, the torsion resistance of the new boom is substantially greater than previously known boom constructions.

What is claimed is:

1. In a backhoe arrangement, a vertically extending elongated support attachment having a mounting portion thereon defining upper and lower horizontal pivot axes, an elongated boom comprising two transversely spaced rectangular hollow boom sections and having a sleeve extending therebetween at one end, said sleeve defining a rigid interconnection between said hollow boom sections, and being pivoted on said lower pivot axis through a neutral intermediate position wherein said boom sections extend substantially vertically so that said upper pivot axis is located in a space between said sections, a pair of aligned sleeves secured to respective boom sections intermediate opposite ends with a shaft extending through said sleeves, a double-acting boom cylinder assembly including a cylinder pivotally mounted on said upper pivot axis a piston rod pivoted on said shaft to extend in said space between said boom sections, said boom cylinder assembly being extendable and retractable to effect pivotal movement of said boom and said cylinder assembly on said lower pivot axis to either side of said neutral intermediate position, and a material handling unit having a portion received between said opposite ends with a bearing member defined in said portion, and shaft means received in said bearing means or rigidly interconnecting the opposite ends of said boom sections and pivotally mounting said material handling unit on said opposite ends of said boom section.

2. In a backhoe arrangement in accordance with claim 1, in which said material handling unit includes a dipper stick assembly pivoted between said opposite ends of said boom sections, further including bracket means mounted on an intermediate portion of each boom section and fluid ram means pivotally mounted at one end to said bracket means and at an opposite end to said dipper stick assembly to effect swinging movement of said dipper stick assembly on said boom sections.

3. A backhoe arrangement in accordance with claim 2, further including conduit means within at least one of said hollow boom sections for supplying fluid to said fluid ram means.

4. In a backhoe having a vertically extending elongated support attachment having a mounting portion thereon defining upper and lower pivot axes; an elongated boom comprising two transversely spaced rectangular hollow boom sections; a sleeve extending between said boom sections at one end and connected thereto to provide a rigid connection between said boom sections with said sleeve pivoted on said lower pivot axis to pivotally support said boom on said attachment for vertical swinging movement; said boom sections having open opposite ends with interconnecting means including integral bracket support means having a pair of projections respectively received into the open ends of said boom sections and a sleeve on said bracket support means; a material handling unit pivoted on said sleeve; and a double-acting boom cylinder assembly having one end pivoted on said upper pivot axis and an opposite end pivotally supported between said boom sections.

5. A backhoe as defined in claim 4, in which said material handling unit includes a unit fluid ram with conduit means extending through at least one of said hollow boom sections to said unit fluid ram.

6. A backhoe as defined in claim 5, further including a hollow bracket extending from each hollow boom section and a further fluid ram having one end pivoted on said brackets and an opposite end pivoted on said material handling unit and further conduit means extending through at least a portion of one of said hollow boom sections and hollow brackets.

* * * * *

UNITED STATES PATENT AND TRADEMARK OFFICE

CERTIFICATE OF CORRECTION

PATENT NO. : 4,074,821

DATED : February 21, 1978

INVENTOR(S) : Elton B. Long

It is certified that error appears in the above-identified patent and that said Letters Patent are hereby corrected as shown below:

Column 1, line 53, "proved" should read --provided--.

Column 2, line 32, "ach" should read --each--.

Column 3, line 4, after "fluid" insert --ram--.

Column 6, line 16, "322" should read --332--.

Column 8, line 16, "simple" should read --single--.

Column 8, line 39, after "axis" insert --and--.

Column 8, line 48, "or" should read --for--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*